US008287061B2

(12) United States Patent
Ha

(10) Patent No.: US 8,287,061 B2
(45) Date of Patent: Oct. 16, 2012

(54) REFRIGERATOR AND CONTROL METHOD THEREOF

(75) Inventor: Myung-Woo Ha, Changwon (KR)

(73) Assignee: LG Electronics Inc., Seoul (KR)

( * ) Notice: Subject to any disclaimer, the term of this patent is extended or adjusted under 35 U.S.C. 154(b) by 151 days.

(21) Appl. No.: 12/375,815

(22) PCT Filed: Aug. 3, 2007

(86) PCT No.: PCT/KR2007/003756

§ 371 (c)(1),
(2), (4) Date: Nov. 9, 2009

(87) PCT Pub. No.: WO2008/016284

PCT Pub. Date: Feb. 7, 2008

(65) Prior Publication Data

US 2010/0095601 A1 Apr. 22, 2010

(30) Foreign Application Priority Data

Aug. 4, 2006 (KR) ..... 10-2006-0073904

(51) Int. Cl.
*A47B 96/04* (2006.01)
*A47B 95/02* (2006.01)

(52) U.S. Cl. ..... 312/405; 312/319.2

(58) Field of Classification Search ..... 312/405, 312/405.1, 327, 328, 321.5, 319.2, 319.3, 312/292; 16/286; 49/386, 387; 292/DIG. 4, 292/DIG. 71, 137, 174
See application file for complete search history.

(56) References Cited

U.S. PATENT DOCUMENTS

| | | | | | |
|---|---|---|---|---|---|
| 1,081,707 | A | * | 12/1913 | Valentine | 292/271 |
| 1,114,675 | A | * | 10/1914 | Blomeen | 292/271 |
| 2,136,558 | A | * | 11/1938 | Manshel | 62/266 |
| 2,398,602 | A | * | 4/1946 | Sibley et al. | 292/278 |
| 2,417,401 | A | * | 3/1947 | Steinhorst | 217/60 C |
| 2,649,322 | A | * | 8/1953 | Mack | 292/173 |
| 2,724,609 | A | * | 11/1955 | Donnelly | 292/266 |
| 2,783,492 | A | * | 3/1957 | Duncan | 16/80 |
| 2,844,111 | A | * | 7/1958 | Sharpe | 109/63.5 |
| 2,910,336 | A | * | 10/1959 | Mustee | 312/328 |
| 3,058,146 | A | * | 10/1962 | Harrison et al. | 16/66 |
| 3,785,004 | A | * | 1/1974 | Stoffregen | 16/49 |
| 3,792,556 | A | * | 2/1974 | Anghinetti et al. | 52/1 |
| 4,110,867 | A | * | 9/1978 | Gwozdz | 16/82 |
| 4,357,731 | A | * | 11/1982 | Strauss | 16/70 |
| 4,657,292 | A | * | 4/1987 | Bruck | 292/80 |
| 5,209,082 | A | * | 5/1993 | Ha | 62/265 |
| 5,248,174 | A | * | 9/1993 | Matz et al. | 292/338 |
| 5,908,228 | A | * | 6/1999 | Lee | 312/405 |
| 5,937,481 | A | * | 8/1999 | Faringosi | 16/332 |
| 6,055,823 | A | * | 5/2000 | Baker et al. | 62/265 |
| 6,453,804 | B1 | * | 9/2002 | Lee | 99/470 |

(Continued)

FOREIGN PATENT DOCUMENTS

JP 10-320626 * 12/1998

(Continued)

*Primary Examiner* — Darnell Jayne
*Assistant Examiner* — Kimberley S Wright
(74) *Attorney, Agent, or Firm* — Birch, Stewart, Kolasch & Birch, LLP

(57) ABSTRACT

A refrigerator and a method of controlling the refrigerator are provided. A home bar door is closed when external pressure is applied to the home bar door in a state where the home bar door is opened.

4 Claims, 11 Drawing Sheets

U.S. PATENT DOCUMENTS

| | | | | |
|---|---|---|---|---|
| 6,711,856 | B1 * | 3/2004 | Hoffman | 49/386 |
| 7,059,693 | B2 * | 6/2006 | Park | 312/405.1 |
| 7,108,342 | B2 * | 9/2006 | Shin et al. | 312/405 |
| 7,156,447 | B2 * | 1/2007 | Watanabe | 296/146.4 |
| 7,195,293 | B2 * | 3/2007 | Ala | 292/254 |
| 7,278,664 | B2 * | 10/2007 | Su et al. | 292/304 |
| 7,318,633 | B2 * | 1/2008 | Shin et al. | 312/405 |
| 7,360,278 | B2 * | 4/2008 | Jang et al. | 16/357 |
| 7,784,219 | B2 * | 8/2010 | Yoshikawa et al. | 49/379 |
| 7,806,491 | B2 * | 10/2010 | Lee et al. | 312/405.1 |
| 2003/0030299 | A1 * | 2/2003 | Cleland et al. | 296/146.8 |
| 2004/0046401 | A1 * | 3/2004 | Watanabe | 292/262 |
| 2004/0148958 | A1 * | 8/2004 | Park | 62/381 |
| 2004/0178710 | A1 * | 9/2004 | Kim et al. | 312/405 |
| 2004/0183415 | A1 * | 9/2004 | Kim | 312/402 |
| 2005/0132535 | A1 * | 6/2005 | Jang et al. | 16/357 |
| 2005/0144970 | A1 * | 7/2005 | Cho et al. | 62/441 |
| 2005/0156433 | A1 * | 7/2005 | Nemoto et al. | 292/163 |
| 2006/0097610 | A1 * | 5/2006 | Lee et al. | 312/401 |
| 2006/0119240 | A1 * | 6/2006 | Shin et al. | 312/405 |
| 2006/0152121 | A1 * | 7/2006 | Son et al. | 312/405 |
| 2006/0226751 | A1 * | 10/2006 | Park | 312/405.1 |
| 2007/0086151 | A1 * | 4/2007 | Oh et al. | 361/680 |
| 2008/0252191 | A1 * | 10/2008 | Kim et al. | 312/405.1 |
| 2009/0009043 | A1 * | 1/2009 | Gwak | 312/405.1 |

FOREIGN PATENT DOCUMENTS

| | | | | |
|---|---|---|---|---|
| JP | 2007046243 | A | * | 2/2007 |
| JP | 200756522 | | * | 8/2007 |
| KR | 88-16620 | U | | 10/1988 |
| KR | 10-2001-0027573 | A | | 4/2001 |
| KR | 10-2005-0062085 | A | | 6/2005 |

* cited by examiner

[Fig. 1]
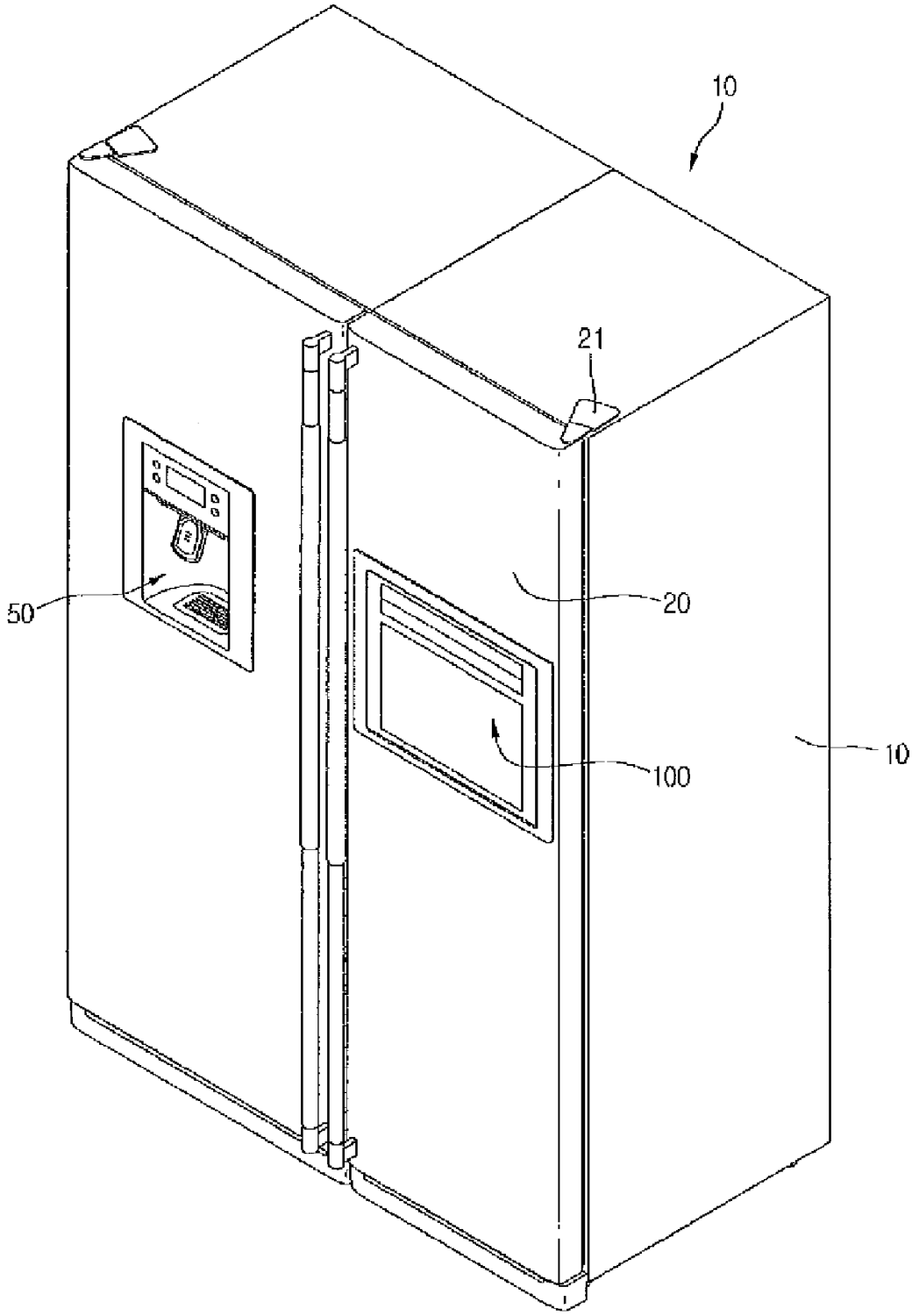

[Fig. 2]
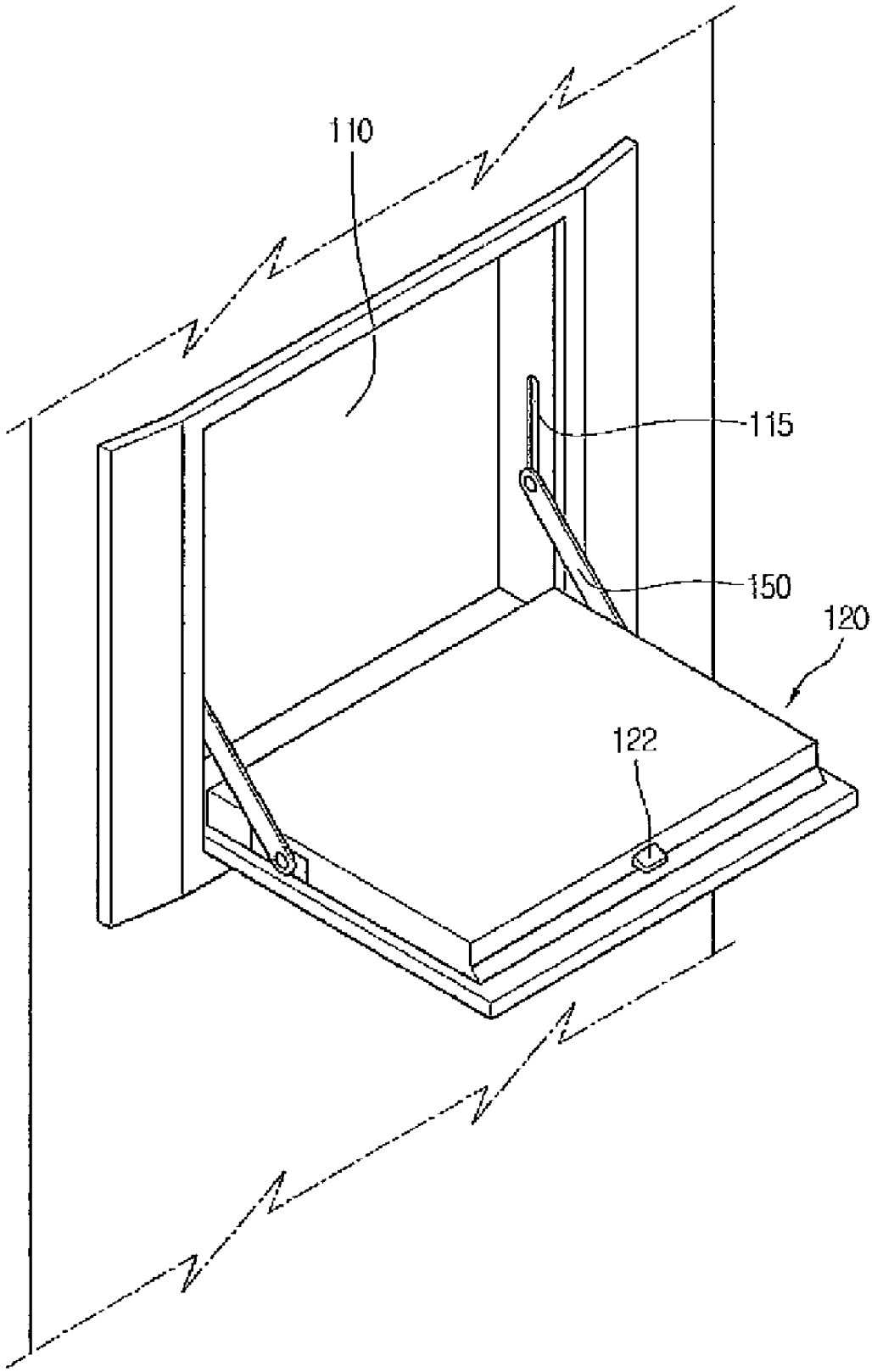

[Fig. 3]
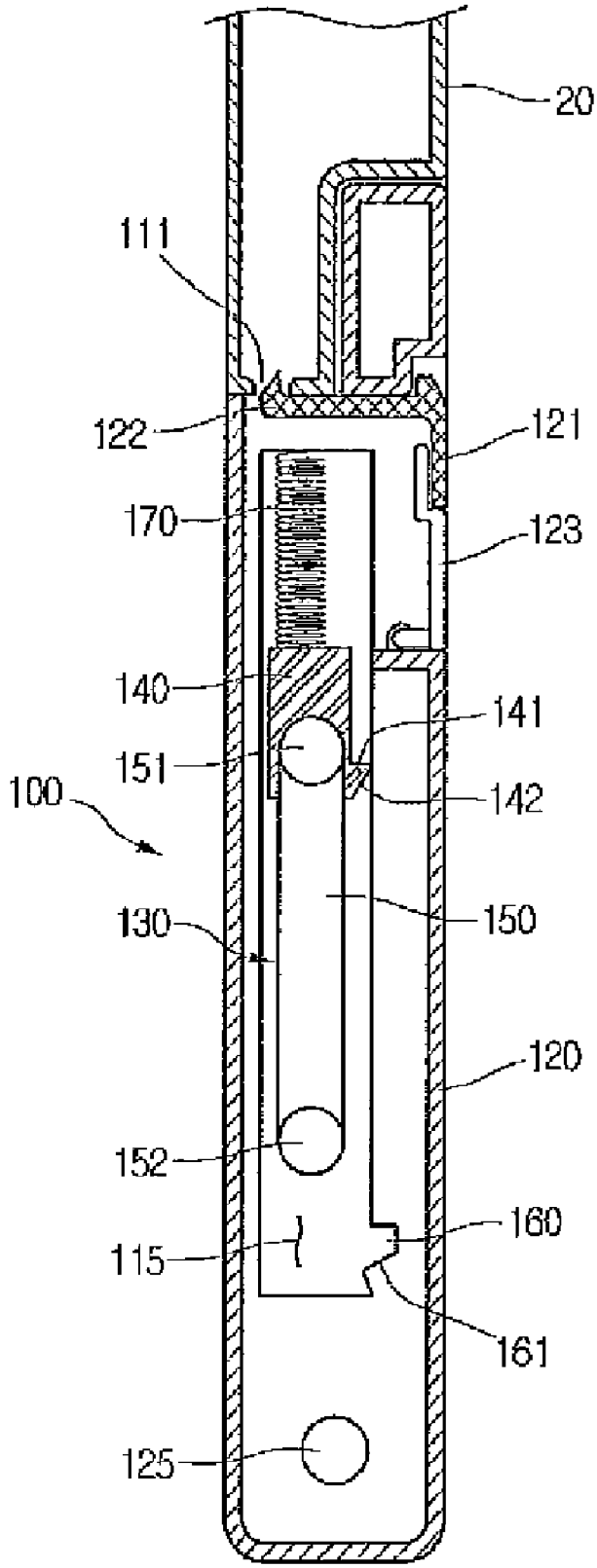

[Fig. 4]
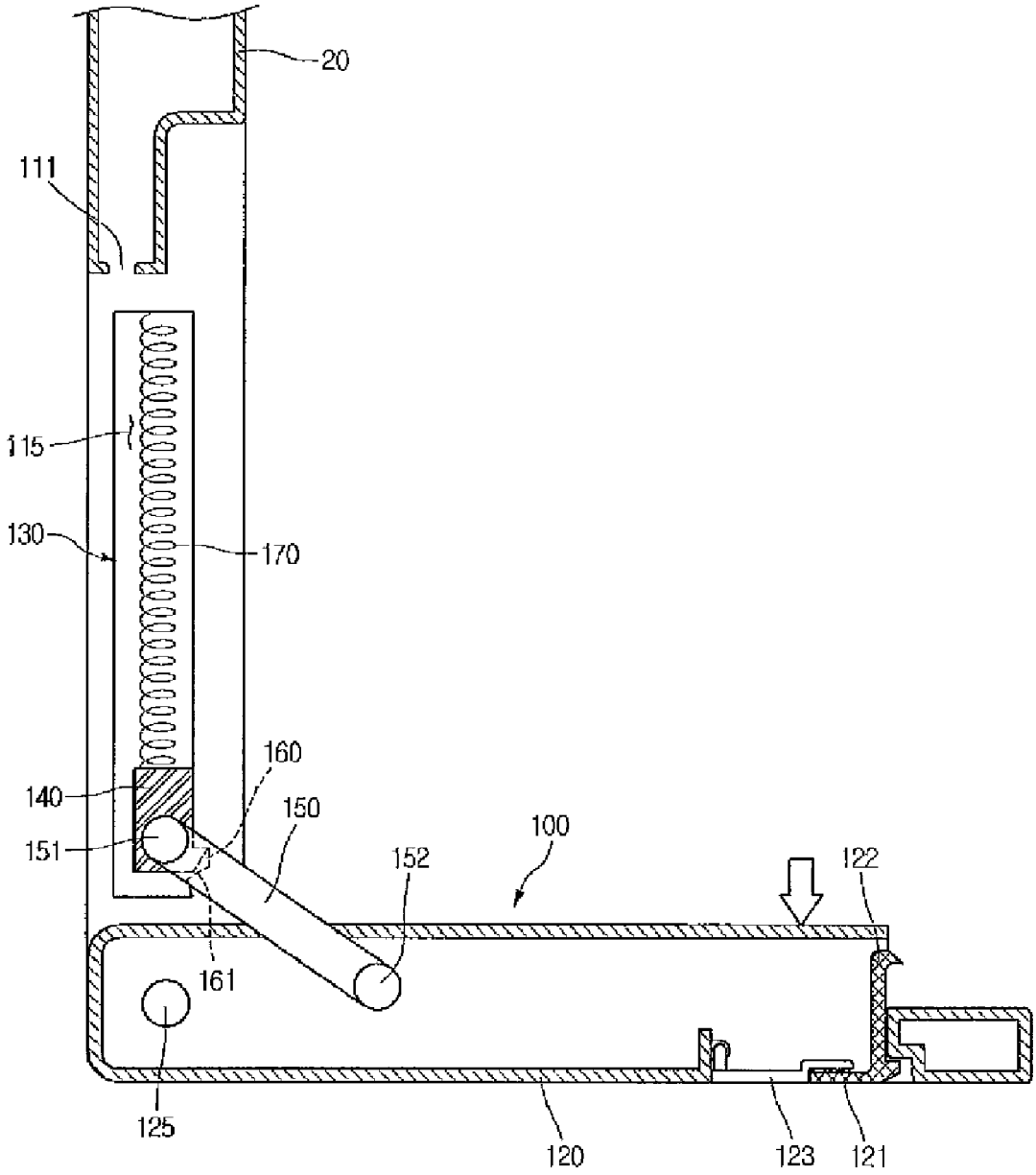

[Fig. 5]
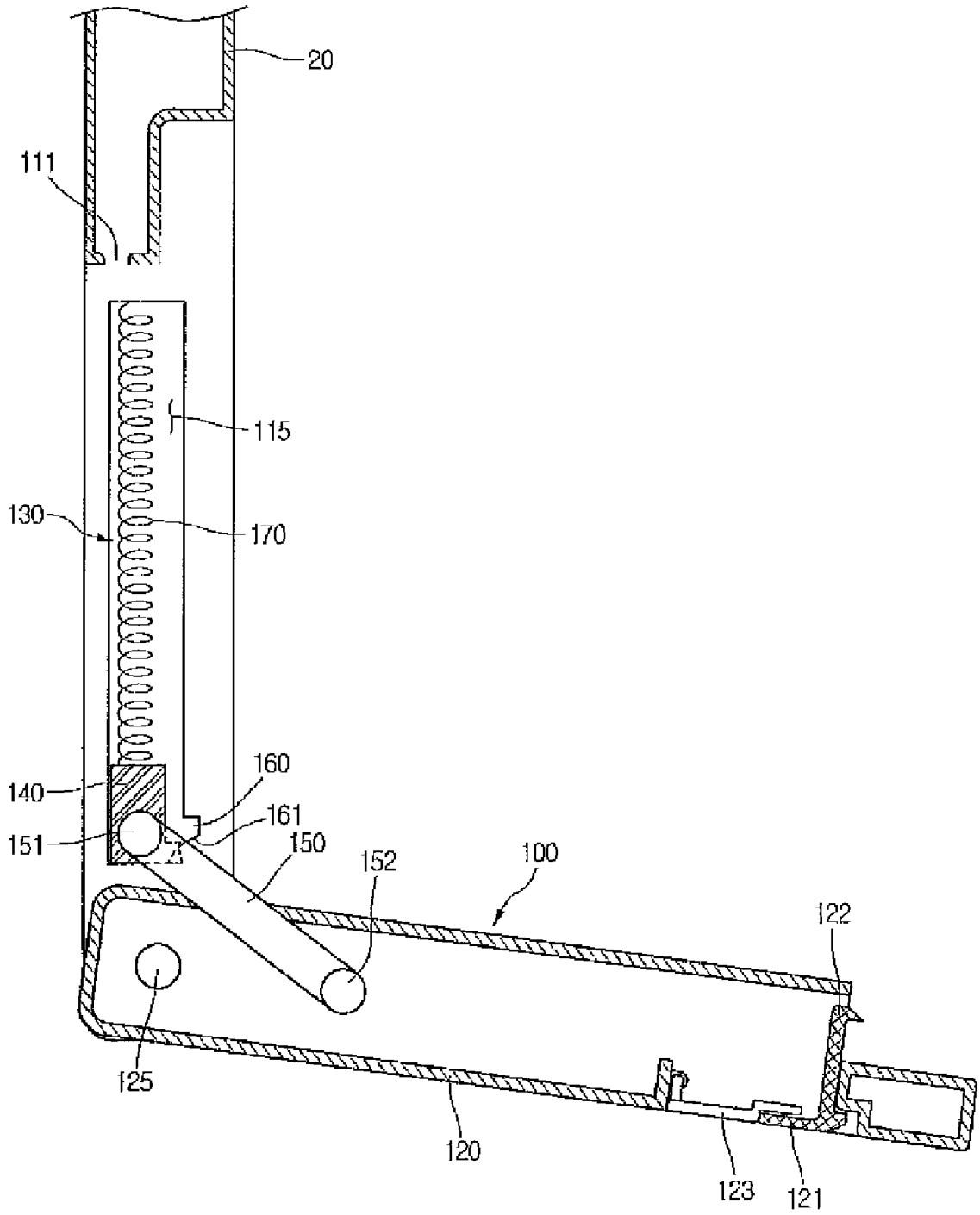

[Fig. 6]
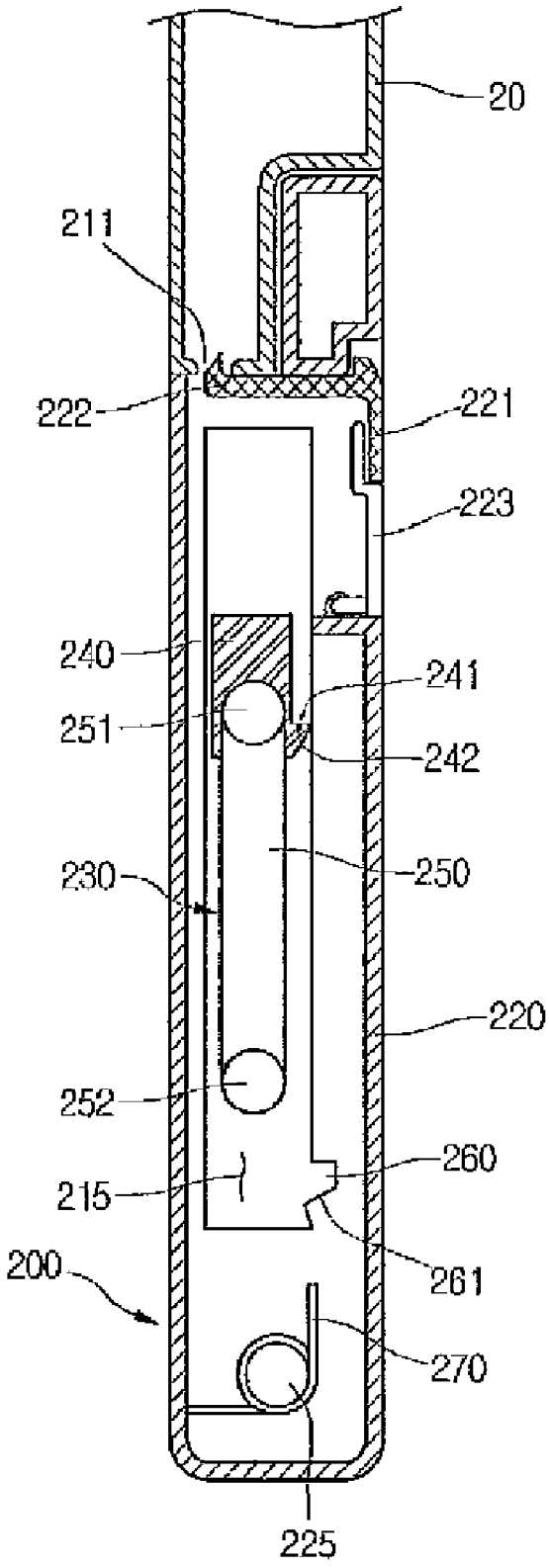

[Fig. 7]
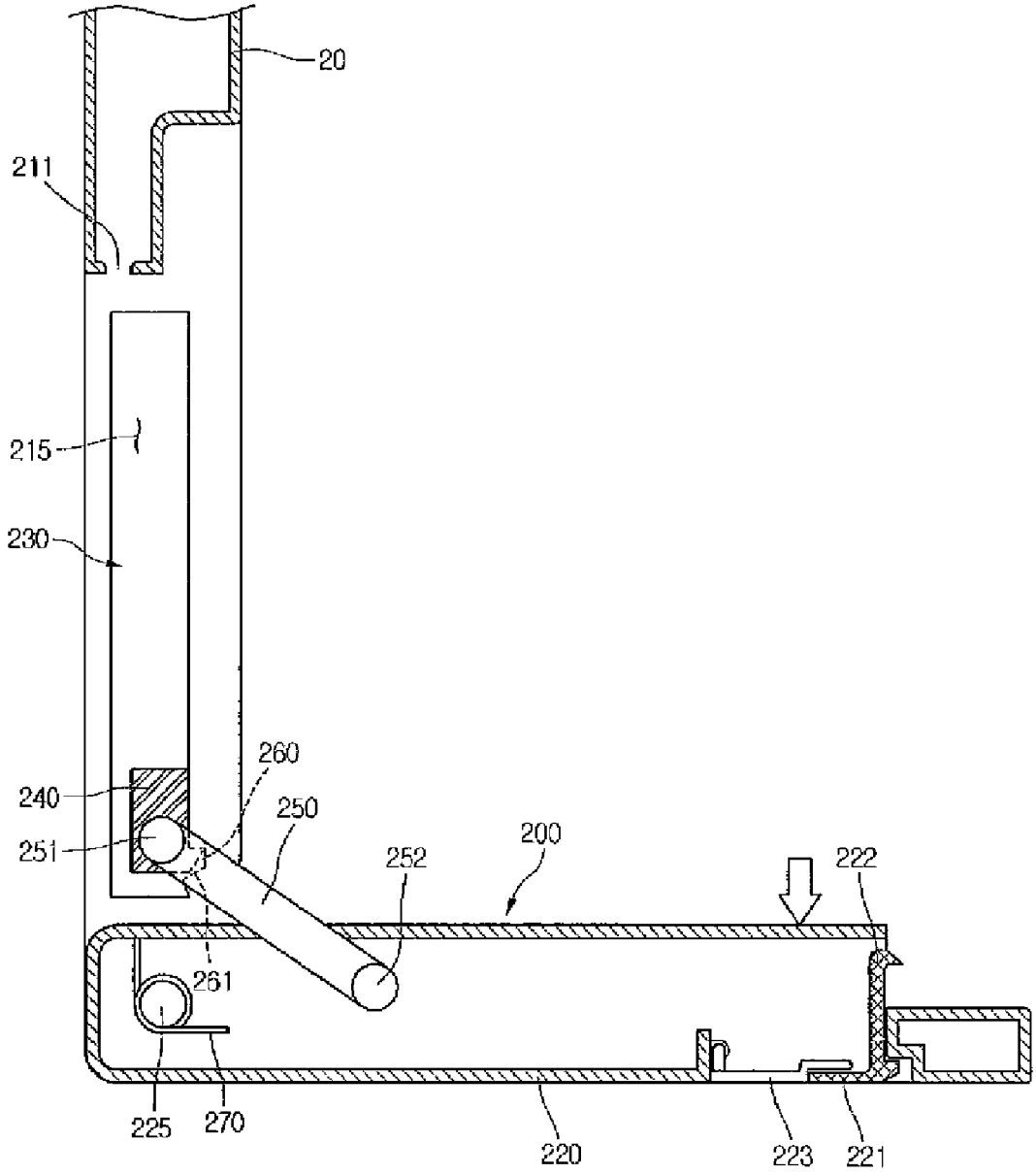

[Fig. 8]
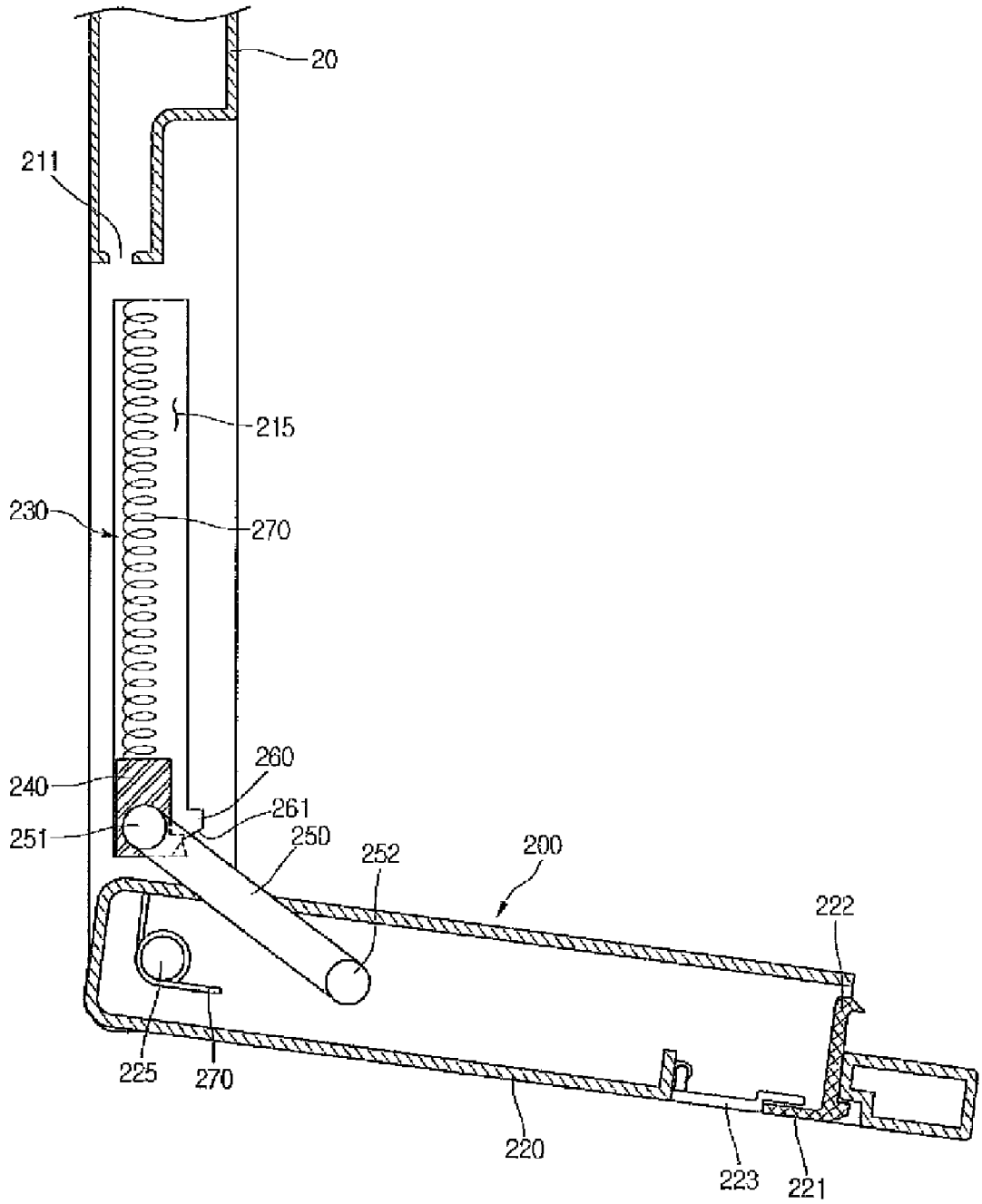

[Fig. 9]
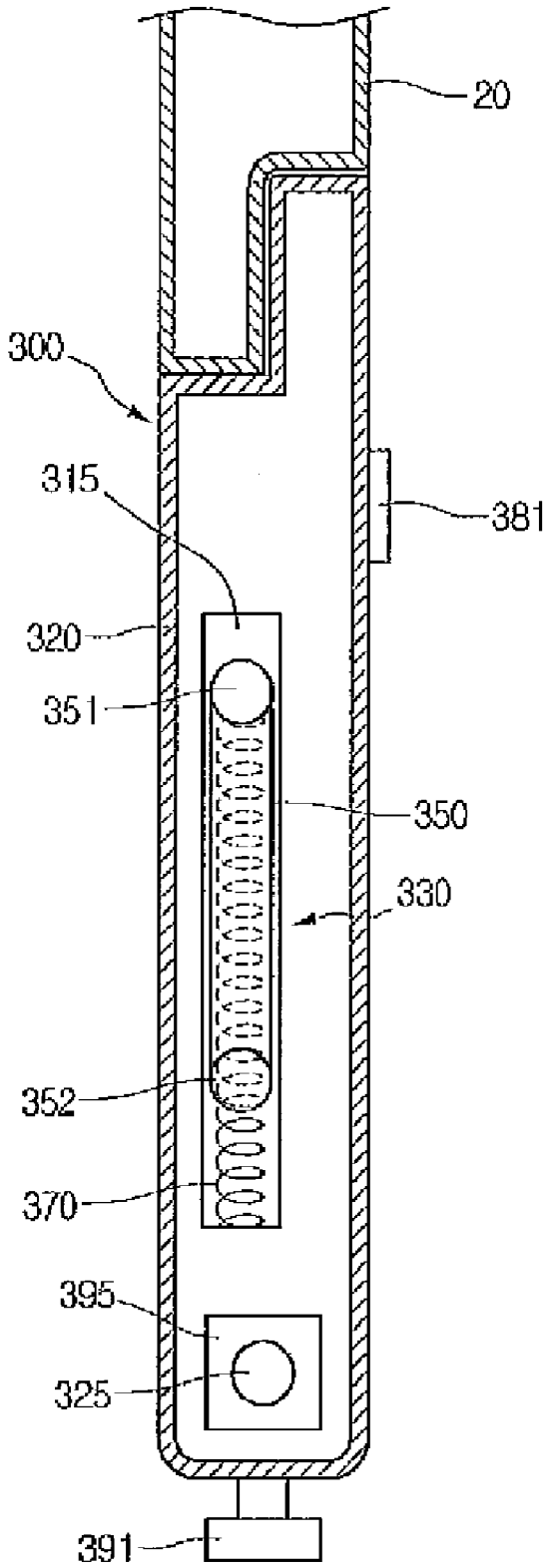

[Fig. 10]
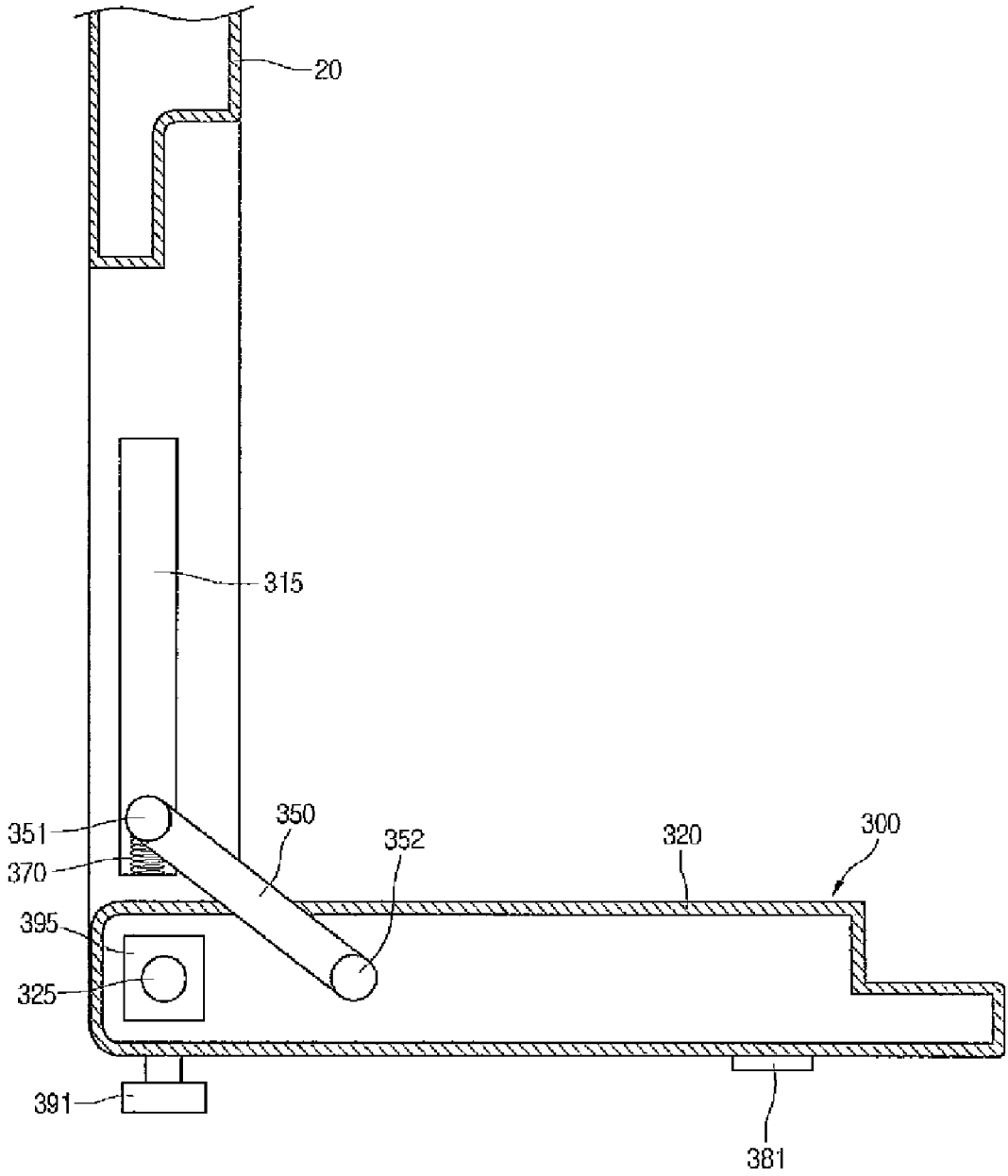

[Fig. 11]
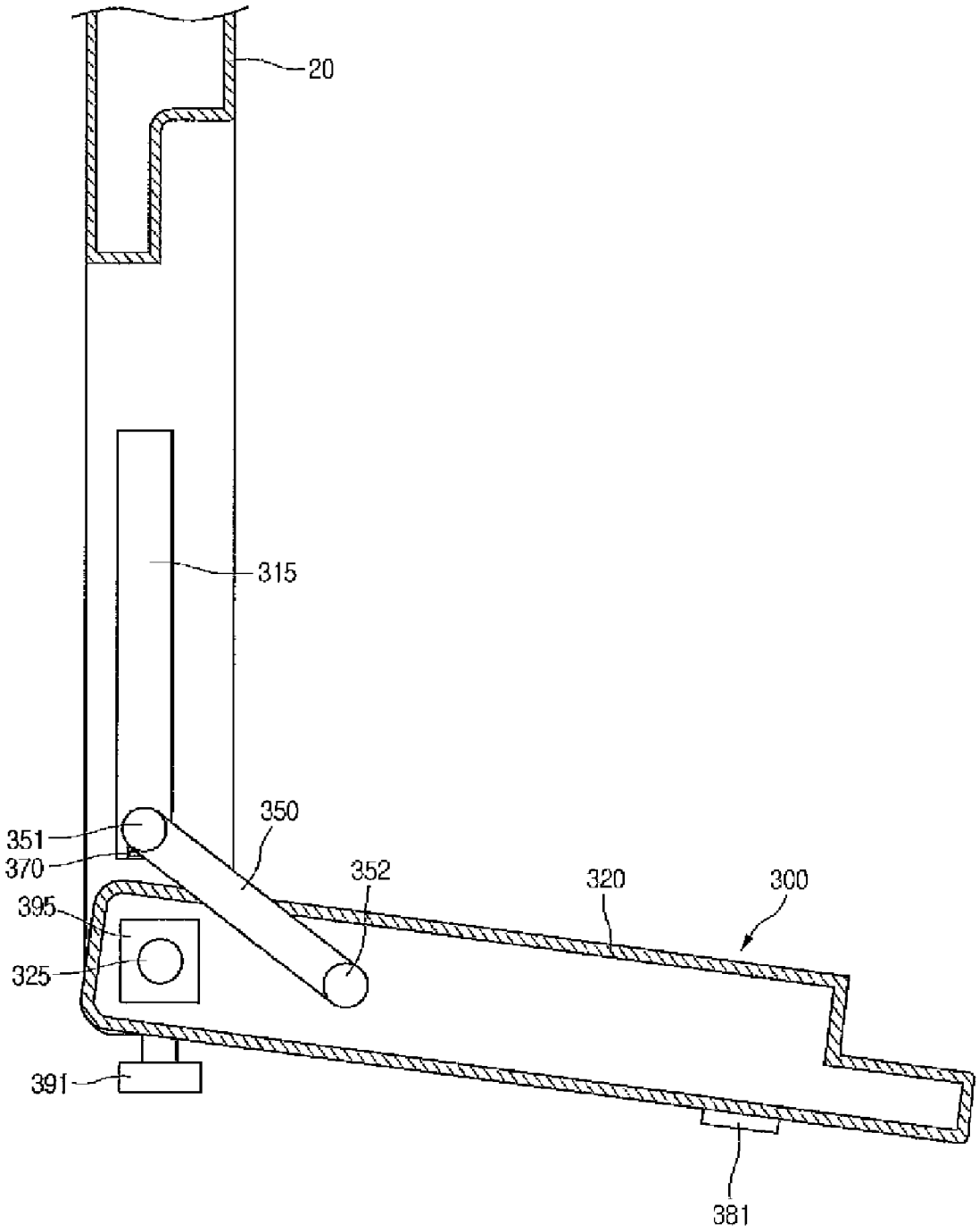

REFRIGERATOR AND CONTROL METHOD THEREOF

TECHNICAL FIELD

The present disclosure relates to a refrigerator having a home bar.

BACKGROUND ART

A refrigerator is a home appliance that stores food at a low temperature. A home bar is provided to the refrigerator to take out the food without opening a door of the refrigerator. A variety of items such as beverages, cosmetics, and the like can be stored in the home bar at a low temperature. The home bar can reduce power consumption as the user can take out the food without opening the door.

In a related art refrigerator, after the user take out the food from the home bar, a home bar door pivots upward to close the home bar. In this case, the weight of the home bar door is fully applied to the hand of the user, which causes emotional complaints from the user.

Further, when the user takes out a lot of food from the home bar using both his/her hands, he/she must close the home bar door after laying down the food he/she is grasping. This is inconvenient for the user.

DISCLOSURE OF INVENTION

Technical Problem

Embodiments provide a refrigerator that can emotionally satisfy a user when the user closes a home bar door and allows the user to close the home bar door in a state where the user holds food using both his/her hands.

Technical Solution

In one embodiment, a refrigerator includes a door provided with a home bar opening, a home bar door rotatably installed on the home bar opening, and an opening/closing unit that is coupled to both of the home bar door and the home bar opening to close the home bar door when external force is applied in a state where the home bar door is opened.

In another embodiment, a refrigerator includes a door provided with a home bar opening, a home bar door rotatably installed on the home bar opening, and an opening/closing unit having a first side that is movably coupled to either the home bar door or the home bar opening to close the home bar door when external force is applied in a state where the home bar door is opened.

The opening/closing unit may include a moving member that is movably coupled to either the home bar opening or the home bar door, a coupling member having a first side coupled to the moving member to move the moving member when the home bar is opened and closed, a locking groove that locks the moving member in a state where the home bar door is opened, and an elastic member applying force for closing the home bar door.

One of the home bar opening and the home bar door may be provided with a guide slit for guiding movement of the moving member.

The elastic member may be connected to the moving member to apply the force to the home bar door by moving the moving member. Further, the elastic member may be connected to the moving member to apply the force to the home bar door by moving the moving member.

The moving member may be provided with a hook step that is configured to be interlocked with the locking groove.

An inclined surface may be formed on a lower portion of the locking groove so that the moving member can be released from the locking groove.

The opening/closing unit may be unlocked when the home bar door is pressed downward.

The opening/closing unit may further include a pressure detecting unit that detects pressure applied to the home bar door in a state where the home bar door is opened and a driving unit that closes the home bar door when a pressure detecting signal is transmitted from the pressure detecting unit.

In still another embodiment, a method of controlling a refrigerator includes detecting if external force is applied in a state where a home bar door is opened and closing the home bar door when the external force is detected.

The home bar door may be closed only when the detected external pressure is higher than a reference value.

Advantageous Effects

According to the embodiments, when the home bar door is pushed, the home bar door is automatically closed, and thus the user can be emotionally satisfied.

In addition, the user can conveniently close the home bar door even when he/she is holding food.

BRIEF DESCRIPTION OF THE DRAWINGS

FIG. 1 is a perspective view of a refrigerator according to an embodiment.

FIG. 2 is a perspective view of the refrigerator of FIG. 1, when a home bar door is opened.

FIG. 3 is a sectional view of a home bar door according to an embodiment.

FIG. 4 is a sectional view of the home bar door of FIG. 3, when the home bar door is opened.

FIG. 5 is a sectional view of the home bar door of FIG. 3, when the home bar door is opened and unlocked.

FIG. 6 is a sectional view of a home bar door according to another embodiment.

FIG. 7 is a sectional view of the home bar door of FIG. 6, when the home bar door is opened.

FIG. 8 is a sectional view of the home bar door of FIG. 6, when the home bar is pressed by external force.

FIG. 9 is a sectional view of a home bar door according to another embodiment.

FIG. 10 is a sectional view of the home bar door of FIG. 9, when the home bar door is opened.

FIG. 11 is a sectional view of the home bar door of FIG. 6, when the home bar door is opened and unlocked.

BEST MODE FOR CARRYING OUT THE INVENTION

Reference will now be made in detail to the embodiments of the present disclosure, examples of which are illustrated in the accompanying drawings.

FIG. 1 is a perspective view of a refrigerator according to an embodiment.

Referring to FIG. 1, a refrigerator (not shown) includes a main body 10 defining storing chambers and left and right doors 20 for opening/closing the storing compartments. Each of the left and right doors 20 is pivotally installed by a hinge 21.

A dispenser 21 for dispensing ice or cold water stored in the refrigerator to an external side is formed on the left door 20.

A home bar 100 is formed on the right door 20. A variety of items such as beverages or cosmetics may be stored in the home bar 10 at a low temperature. The home bar 100 allows a user to take out the items without opening the right door 20.

FIG. 2 is a perspective view of the refrigerator when a home bar door is opened.

Referring to FIG. 2, a home bar opening 110 is formed in the right door 20 and a home bar door 120 is provided on the home bar opening 110 to be opened and closed the home bar. At this point, the home bar door 120 is opened and closed while pivoting about a lower end of the home bar 100.

A hook protrusion 122 is formed on an upper portion of the home bar door 120 and a hook groove 111 that is designed to be interlocked with the hook protrusion 122 is formed on an upper portion of the home bar opening 110 (see FIG. 3).

guide slits 115 are vertically formed on both sides of the home bar opening 110. A first end of a coupling member 150 is movably coupled to the guide slits 115. A second end of the coupling member 150 is rotatably coupled to the both sides of the home bar door 120. The following will describe a structure for opening and closing the home bar door 120 through a pivotal motion.

FIG. 3 is a sectional view of a home bar door according to an embodiment.

Referring to FIG. 3, a lower portion of the home bar door 120 is coupled to a hinge portion 125. Therefore, the home bar door 120 rotates upward and downward about the hinge portion 125.

A handle 121 is coupled to an upper portion of the home bar door 120. A hook 122 is formed on the handle 121 and a hook groove 111 in which the hook 122 is interlocked is formed on the upper portion of the home bar opening 110. At this point, when the handle 121 is pulled frontward (rightward in FIG. 3), the handle 121 rotates and thus the hook 122 is released from the hook groove 111. In addition, the hook 122 of the handle 121 is hooked in the hook groove 111 when the home bar door 120 is closed.

A handle cover 123 is coupled to a lower portion of the handle 121. When the user presses the handle cover 123 rearward (leftward in FIG. 3) using his/her finger, the handle cover 123 rotates so that the finger can be inserted between the handle 121 and the cover 123.

The opening/closing unit 130 is movable coupled to both of the home bar door 120 and the home bar opening 110. The opening/closing unit 130 controls the home bar door 120 such that the home bar door 120 is not closed in a state where the home bar door 120 is opened. In the opened state of the home bar door 120, the opening/closing unit 130 allows the home bar door 120 to be closed when external force is applied. The following will describe an embodiment of the opening/closing unit 130.

The opening/closing unit 130 includes a moving member 140, a coupling member 150, a locking groove 160, and an elastic member 170.

The moving member 140 is movably coupled to the home bar opening 110. At this point, the moving member 140 is guided by the guide slits 115 formed in the home bar opening 110. Although the guide slits 115 are illustrated as being vertically formed at both sides of the home bar opening 110, the present disclosure is not limited to this configuration. The guide slits 115 may be formed in the home bar door 120. When the guide slit 115 are formed in the home bar door 120, the moving member 140 is movably coupled to the home bar door 120 by the guide slits 115.

A side of the coupling member 150 is coupled to the moving member 140 and the other side of the coupling member 150 is pivotally coupled to the home bar door 120 by the hinge portion 152. At this point, the moving member 140 is hingedly coupled to the side of the coupling member 150. Needless to say, the moving member 140 may be integrally formed with the side of the coupling member 150. The coupling member 150 is a thin and long panel type link.

The locking groove 160 is designed to allow the moving member 140 to be locked in the guide slits 115 in a state where the home bar door 120 is fully opened. At this point, when the home bar door 120 is fully opened, the moving member 140 moves to a lower portion of the guide slit 115. Therefore, the locking groove 160 is formed on the lower portion of the guide slit 115.

A hook stop 141 may be formed on the moving member 140 so that the moving member 140 is hooked on the locking groove 160 in a state when the home bar door 120 is opened.

At this point, an inclined surface 142 is formed on a lower portion of the hook step 141 and an inclined surface 161 is formed on a lower portion of the locking groove 160. Therefore, when the home bar door 120 is pressed downward in a state where it is fully opened, the inclined surface 142 of the hook step 141 slides along the inclined surface 161 of the locking groove 160 and thus the hook step 141 of the moving member 140 is released from the locking groove 160. As a result, the locking state of the home bar door is released.

The elastic member 170 biases the home bar door 120 in a direction where the home bar door is closed. For example, the elastic member 170 is connected to the moving member 140 to pull the moving member 140 in a state where the home bar door 120 is opened. In a state where the home bar door 120 is closed, the elastic member 170 applies restoring force to the moving member 140. The elastic member 170 is disposed in the guide slit 115 such that it is not removed from the guide slit 115 even when it expands by the movement of the moving member.

The following will describe an operation of the above-described embodiment.

Referring to FIG. 3, when the user pulls the handle 121 in a state where the user presses the handle cover 123, the hook 122 is release from the hook groove 111, the home bar door 120 is unlocked.

FIG. 4 is a sectional view of the home bar door of FIG. 3, when the home bar door is opened.

Referring to FIG. 4, the user presses the home bar door 120 downward after removing a desired item. Then, the coupling member 150 pulls the moving member 140 downward. Next, the hook step 141 of the moving member 140 is released from the locking groove 160. At this point, the coupling member 150 rotates about the hinge portion 152 coupled to the home bar door 120, in the course of which the coupling member 150 pulls the moving member 140. As the moving member 140 moves downward, the elastic member 170 expands.

When the home bar door 120 is completely opened, the hook step 141 of the moving member 140 is locked in the locking groove 160 formed on the lower portion of the guide slit 115. Therefore, even when the moving member 140 is pulled upward by the elastic member 170, since the hook step 141 of the moving member 140 is locked in the locking groove 160, the home bar door is locked to maintain the opened state.

FIG. 5 is a sectional view of the home bar door of FIG. 3, when the home bar is opened and unlocked.

Referring to FIG. 5, the user presses the home bar door 120 downward after taking out a desired item. Then, the coupling member 150 pulls the moving member 140 downward. The hook step 141 of the moving member 140 is released from the locking groove 160. At this point, the hook step 141 is smoothly released from the locking groove 160 as the inclined surface 142 of the hook step 141 slides along the inclined surface 142 of the locking groove 160.

When the pressing state of the home bar door 120 is released, the moving member 140 moves upward along the guide slit 115 by the returning force of the elastic member 170. At this point, the returning force of the elastic member 170 is applied to the home bar door 120 by the coupling member 150. Therefore, since the home bar door 120 is closed by the returning force of the elastic member 170 and thus the user can close the home bar door 120 in a state where the items are in both the user's hands. Further, because there is no need to lift the home bar door using a hand, the emotional satisfaction of the user can be improved.

The following will describe another embodiment.

FIG. 6 is a sectional view of a home bar door according to another embodiment.

Referring to FIG. 6, a lower portion of a home bar door 220 is coupled to the hinge portion 225. Therefore, the home bar door 220 rotates upward and downward about the hinge portion 225. The home bar door 220 is opened and closed by an opening/closing unit 230

A handle 221 is coupled at the top of the home bar door 220. A hook 222 is formed on the handle 221, and a hook groove 211 is formed at the top of the home bar opening 210 for the hook 22 to catch on. At this point, when the handle 221 is pulled frontward (rightward in FIG. 6), the handle 221 rotates and thus the hook 122 is released from the hook groove 211. In addition, the hook 222 of the handle 221 is hooked in the hook groove 211 when the home bar door 120 is closed.

A handle cover 223 is coupled to a lower portion of the handle 221. When the user presses the handle cover 223 rearward (leftward in FIG. 6) using his/her finger, the handle cover 223 rotates so that the finger can be inserted between the handle 221 and the cover 223.

The opening/closing unit 230 is movably coupled to both the home bar door 220 and the home bar opening 210. At this point, a side of the opening/closing unit 230 is movably coupled to either the home bar opening 210 or the home bar door 220. The opening/closing unit 230 interlocks the home bar door 220 such that the home bar door 220 is not closed in a state where the home bar door 220 is opened. In the opened state of the home bar door 220, the opening/closing unit 230 allows the home bar door 220 to be closed when external force is applied. The following will describe an embodiment of the opening/closing unit 230.

The opening/closing unit 230 includes a moving member 240, a coupling member 250, a locking groove 260, and an elastic member 270.

The moving member 240 is movable coupled to the home bar opening 210. At this point, the moving member 240 is guided by the guide slits 215 formed in the home bar opening 210. Although the guide slits 215 are illustrated as being vertically formed at both sides of the home bar opening 210, the present disclosure is not limited to this configuration. The guide slits 215 may be formed in the home bar door 220. When the guide slit 215 are formed in the home bar door 220, the moving member 240 is movably coupled to the home bar door 220 by the guide slits 215.

A side of the coupling member 250 is coupled to the moving member 240 and the other side of the coupling member 250 is pivotally coupled to the home bar door 220 by the hinge portion 252. At this point, the moving member 240 is hingedly coupled to the side of the coupling member 250. Needless to say, the moving member 240 may be integrally formed with the side of the coupling member 250. The coupling member 250 is a thin, long panel type link.

The locking groove 260 is designed to allow the moving member 240 to be locked in the guide slits 215 in a state where the home bar door 220 is fully opened. At this point, when the home bar door 220 is fully opened, the moving member 240 moves to a lower portion of the guide slit 215. Therefore, the locking groove 260 is formed on the lower portion of the guide slit 215.

A hook stop 241 may be formed on the moving member 240 so that the moving member 240 is hooked on the locking groove 260 in a state when the home bar door 120 is opened.

At this point, an inclined surface 242 is formed on a lower portion of the hook step 241 and an inclined surface 261 is formed on a lower portion of the locking groove 260. Therefore, when the home bar door 220 is pressed downward in a state where it is fully opened, the inclined surface 242 of the hook step 241 slides along the inclined surface 261 of the locking groove 260 and thus the hook step 241 of the moving member 240 is released from the locking groove 260. As a result, the locking state of the home bar door is released.

The elastic member 270 biases the home bar door 220 in a direction where the home bar door is closed. For example, the elastic member 270 is connected to the hinge portion 225 of the home bar door 220 to apply elastic force to the home bar door 220 to close the home bar door 220. The elastic member 270 may be a torsion spring or a coil spring.

The following will describe an operation of the above-described embodiment.

Referring to FIG. 6, when the user pulls the handle 221, the home bar door 220 rotates downward about the hinge portion 225 to opening the home bar 200. At this point, the coupling member 250 rotates about the hinge portion 152 coupled to the home bar door 220 and pulls the moving member 240 downward.

FIG. 7 is a sectional view of the home bar door of FIG. 6, when the home bar door is opened.

Referring to FIG. 7, when the handle 221 is pulled, the home bar door 220 rotates downward about the hinge portion 225 to open the home bar 200. Here, the coupling member 250 rotates about the hinge portion 152 coupled to the home bar door 220 to pull the moving member 240 downward.

When the home bar door 220 is fully opened, the hook step 241 of the moving member 240 is locked in the locking groove 260 formed on the lower portion of the guide slit 115. Therefore, even when the moving member 240 is pulled upward by the elastic member 270, since the hook step 241 of the moving member 240 is locked in the locking groove 260, the home bar door 220 is locked to maintain the opened state.

FIG. 8 is a sectional view of the home bar door of FIG. 3, when the home bar is opened and unlocked.

Referring to FIG. 8, the user presses the home bar door 220 downward after taking out a desired item. Then, the coupling member 250 pulls the moving member 240 downward. The hook step 241 of the moving member 240 is released from the locking groove 260. At this point, the hook step 241 is smoothly released from the locking groove 260 as the inclined surface 242 of the hook step 241 slides along the inclined surface 242 of the locking groove 260.

When the pressing state of the home bar door 220 is released, the home bar door 220 rotates by the returning force of the elastic member 270. At this point, the moving member 240 moves upward along the guide slit 215 by the coupling member 250. At this point, since the home bar door 220 is closed by the returning force of the elastic member 270 and thus the user can close the home bar door 220 in a state where the items are in both the user's hands. Further, because there is no need to lift the home bar door using a hand, the emotional satisfaction of the user can be improved.

The following will describe another embodiment of the present disclosure.

FIG. 9 is a sectional view of a home bar door according to another embodiment.

Referring to FIG. 9, a lower portion of a home bar door 320 is coupled to a hinge portion 325. Therefore, the home bar door 320 rotates upward and downward about the hinge portion 325. The home bar door 320 is opened and closed by an opening/closing unit 330. A button 381 for opening the home bar door 320 is provided on the upper portion of the home bar door 320.

The opening/closing unit 330 is movably coupled to both of the home bar door 320 and the home bar opening 310. At this point, a side of the opening/closing unit 330 is movably coupled to either the home bar opening 310 or the home bar door 320. The opening/closing unit 330 interlocks the home bar door 320 such that the home bar door 320 is not closed in a state where the home bar door 320 is opened. In the opened state of the home bar door 320, the opening/closing unit 330 allows the home bar door 320 to be closed when external force is applied. The following will describe an embodiment of the opening/closing unit 330.

The opening/closing unit 330 includes a coupling member 350, an elastic member 370, a pressure detecting unit 391, and a driving unit 395.

A side of the coupling member 350 is movably coupled to the home bar opening 310 and the other side of the coupling member 350 is pivotally coupled to the home bar door 320 by the hinge portion 352. At this point, the side of the coupling member 350 is guided by the guide slits 315 formed in the home bar opening 310. Although the guide slits 315 are illustrated as being vertically formed at both sides of the home bar opening 310, the present disclosure is not limited to this configuration. The guide slits 215 may be formed in the home bar door 320. When the guide slit 315 are formed in the home bar door 320, the side of the coupling member 350 is movably coupled to the home bar door 320 by the guide slits 315. The coupling member 350 is a thin, long panel type link.

The elastic member 370 is coupled to the side of the coupling member 350 to bias the coupling member 350 in a direction where the coupling member 350 is lifted. The elastic member 370 applies returning force to the side of the coupling member 350 in a state where the home bar door is closed. The elastic member 379 is disposed in the guide slit 315 such that it is not removed from the guide slit 315 even when it expands when the home bar door is opened and closed. Since the elastic member 370 applies elastic force to the side of the coupling member 350, it can prevent noise when the side of the coupling member 350 opens and closes the home bar door 320. Here, the elastic member 370 may be omitted in this embodiment.

The driving unit 395 is coupled to the hinge portion 325 of the home bar door 320. A pressure detecting unit 391 is disposed for detecting pressure applied to the home bar door 320 in a state where the home bar door 320 is opened. The pressure detecting unit 391 detects the pressure applied to the home bar door 320 and transmits the detected signal to a control unit. The control unit drives the driving unit 395 in accordance with the detected signal transmitted from the pressure detecting unit 391 to close the home bar door 320.

The following will describe an operation of the above-described embodiment.

FIG. 10 is a sectional view of the home bar door of FIG. 9, when the home bar door is opened.

Referring to FIG. 10, when the button 381 is pushed, the home bar door 320 rotates downward about the hinge portion 325 as electric power is applied, thereby opening the home bar 300. At this point, the other side of the coupling member 350 rotates about the hinge portion 352 and the side 351 of the coupling member 350 moves downward along the guide slit 315. As the coupling member 350 moves downward, the elastic member 370 is compressed.

FIG. 11 is a sectional view of the home bar door of FIG. 10, when the home bar door is opened and unlocked.

Referring to FIG. 11, the user presses the home bar door 320 downward after taking out a desired item. Then, the pressure detecting unit 391 transmits information on the pressure applied to the home bar door 320 to the control unit. The control unit drives the driving unit 395 in accordance with the information transmitted from the pressure detecting unit to close the home bar door. At this point, the other side of the coupling member 350 rotates about the hinge portion 352 of the home bar door and the side of the coupling member 350 moves upward along the guide slit 315, by which the elastic member 370 expands.

Therefore, the home bar door 320 is closed by the driving unit 395, and thus the user can close the home bar door 320 in a state where items are in both the user's hands. Further, there is no need to lift the home bar door using a hand, so that the emotional satisfaction of the user can be improved.

INDUSTRIAL APPLICABILITY

According to the present disclosure, since the home bar door is closed by simply pressing the home bar door in a state where the home bar door is opened, the user can emotionally satisfy. Further, since the home bar door can be easily closed in a state where the items are in both the user's hands, it is very convenient for the user. Therefore, the present disclosure can be highly applied to this field.

The invention claimed is:

1. A refrigerator comprising:

a door provided with an opening;

a home bar door rotatably installed at the door to open or close the opening, the home bar door rotating upwardly and downwardly on a hinge portion provided at a lower portion of the home bar door to open, the hinge portion extending from the home bar door in a horizontal direction, the home bar door comprising:

an inner part defining an interior of the home bar door, the inner part being exposed in a state where the home bar is opened and having a flat surface; and an outer part opposite to the inner part, and an opening/closing unit coupled to both the home bar door and the opening to close the home bar door when external force is applied in a state where the home bar door is opened, the opening/closing unit comprising:

a guide slit defining a moving area;

a moving member that is coupled to the door and the home bar door, the moving member configured to support the home bar door and being movable inside the moving area, the guide slit guiding movement of the moving member;

a locking groove formed on a lower portion of the guide slit that locks the moving member in a state where the home bar door is opened to be approximately at a right angle from the door when the moving member is moved to the lower portion of the guide slit, wherein the moving member is released from the locking groove when the home bar door is moved to be more than the right angle from the door; and an elastic member configured to bias the home bar door so that home bar door is closed when an external force is applied to the home bar door, at least one portion of the elastic member being coupled to the hinge portion to surround the hinge portion, wherein the moving member is coupled to both sides of the home bar door such that goods may be placed on the flat surface.

2. The refrigerator according to claim 1, wherein the opening/closing unit further comprises:

a coupling member having a first side coupled to the moving member to move the moving member when the home bar door is opened and closed.

3. The refrigerator according to claim 1, wherein the moving member is provided with a hook step that is configured to be interlocked with the locking groove.

4. The refrigerator according to claim 1, wherein an inclined surface is formed on a lower portion of the locking groove to enable the moving member to be released from the locking groove.

* * * * *